US006508670B1

(12) United States Patent
Hwang

(10) Patent No.: US 6,508,670 B1
(45) Date of Patent: Jan. 21, 2003

(54) SMALL FORM-FACTOR PLUGGABLE TRANSCEIVER CAGE

(75) Inventor: Jeng-Yih Hwang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/991,322

(22) Filed: Nov. 16, 2001

(51) Int. Cl.[7] ..... H01R 13/648
(52) U.S. Cl. ..... 439/607; 439/108
(58) Field of Search ..... 439/607–610, 439/567, 541.5, 108, 95

(56) References Cited

U.S. PATENT DOCUMENTS 6,234,833 B1 * 5/2001 Tsai et al. ..... 439/541.5
6,244,896 B1 * 6/2001 Boutros ..... 439/607
6,350,152 B1 * 2/2002 Belopolsky et al. ..... 439/541.5
6,419,523 B1 * 7/2002 Jones et al. ..... 439/607

* cited by examiner

*Primary Examiner*—Hien Vu
(74) *Attorney, Agent, or Firm*—Wei Te Chung

(57) ABSTRACT

An SFP transceiver cage includes two sidewalls, a sidewall cover, a top plate, a bottom wall and a rear cover which are collectively preferably made from a single piece of metal plate, and an outer grounding plate. The outer grounding plate has a plurality of outward grounding spring tabs. A plurality of inward grounding spring tabs formed on the top plate project into the cage for contacting an SFP module. The inward and outward grounding spring tabs cooperate to provide multiple grounding paths and prevent EMI. A plurality of compliant legs, needle eye legs and support legs depends from the sidewalls. The compliant and needle eye legs are extended through a PCB, and prevent the cage from moving during solder reflowing. The support legs abut a face of the PCB. The support legs serve as standoffs, separating the cage from the PCB to facilitate accurate soldering.

6 Claims, 5 Drawing Sheets

SMALL FORM-FACTOR PLUGGABLE TRANSCEIVER CAGE

BACKGROUND OF THE INVENTION

1. Field of the Invention

The present invention relates to an optical transceiver cage, and more particularly to a small form-factor pluggable (SFP) transceiver cage of a high data transfer rate program gigabit interface converter (GBIC).

2. Description of the Related Art

Transceiver modules provide bidirectional transmission of data between an electrical interface and an optical data link. The module receives electrically encoded data signals and converts them into optical signals which are then transmitted over the optical data link. The module also receives optically encoded data signals, converts them into electrical signals, and transmits the electrical signals to the electrical interface.

Normally, the transceiver module is mounted on a printed circuit board (PCB) assembly of a host computer, an input/output system, a peripheral device, or a switch. An SFP transceiver module connects with a metal cage assembly mounted on the PCB. The metal cage generally has two parallel sidewalls, a rectangular top, a rectangular bottom, and front and rear ends. The metal cage provides easy interconnection, and is easily installed on the PCB. The cage functions to dissipate electrostatic buildup, and serves as an electromagnetic shield.

A conventional cage forms legs for supporting the cage on the PCB, and a plurality of outwardly projecting grounding tabs adjacent an entrance of the cage for engaging with a grounding chassis. However, there are no structures specifically for ground contacting a housing of an SFP transceiver module which is secured in the cage. The cage does not provide adequate protection for the connecting interface from electromagnetic interference (EMI). In addition, there is no board locking mechanism to safeguard reflowing of solder during soldering of the cage to the PCB. The cage is liable to disengage from the PCB, causing poor soldering.

SUMMARY OF THE INVENTION

Accordingly, an object of the present invention is to provide an SFP transceiver cage which has a plurality of outward and inward grounding spring tabs to facilitate grounding and prevent EMI.

Another object of the present invention is to provide an SFP transceiver cage having legs that enable the cage to be locked on a PCB during soldering of the cage to the PCB.

A further object of the present invention is to provide a sturdy SFP transceiver cage that is easily and inexpensively made essentially from a single metal plate.

To achieve the above objects, an SFP cage in accordance with a preferred embodiment of the present invention comprises two sidewalls, a sidewall cover, a top plate, a bottom wall, a rear cover and an outer grounding plate. The sidewalls, sidewall cover, top plate, bottom wall and rear cover are collectively preferably made from a single piece of metal plate. The outer grounding plate has a plurality of outward grounding spring tabs. A plurality of inward grounding spring tabs formed on the top plate project into a central cavity of the cage for contacting a housing of an SFP module secured in the cage. The inward grounding spring tabs cooperate with the outward grounding spring tabs to provide multiple grounding paths and prevent EMI. A plurality of compliant legs, needle eye legs and support legs depends from the sidewalls. The compliant and needle eye legs are extended through corresponding holes defined in a PCB. The compliant and needle eye legs prevent the cage from moving relative to the PCB during the course of solder reflowing. The support legs abut a face of the PCB. The support legs serve as standoffs, separating the cage from the PCB to facilitate accurate soldering.

Other objects, advantages and novel features of the present invention will be apparent from the following detailed description of a preferred embodiment thereof with reference to the attached drawings, in which:

DETAILED DESCRIPTION OF THE PREFERRED EMBODIMENT

Figure 1:
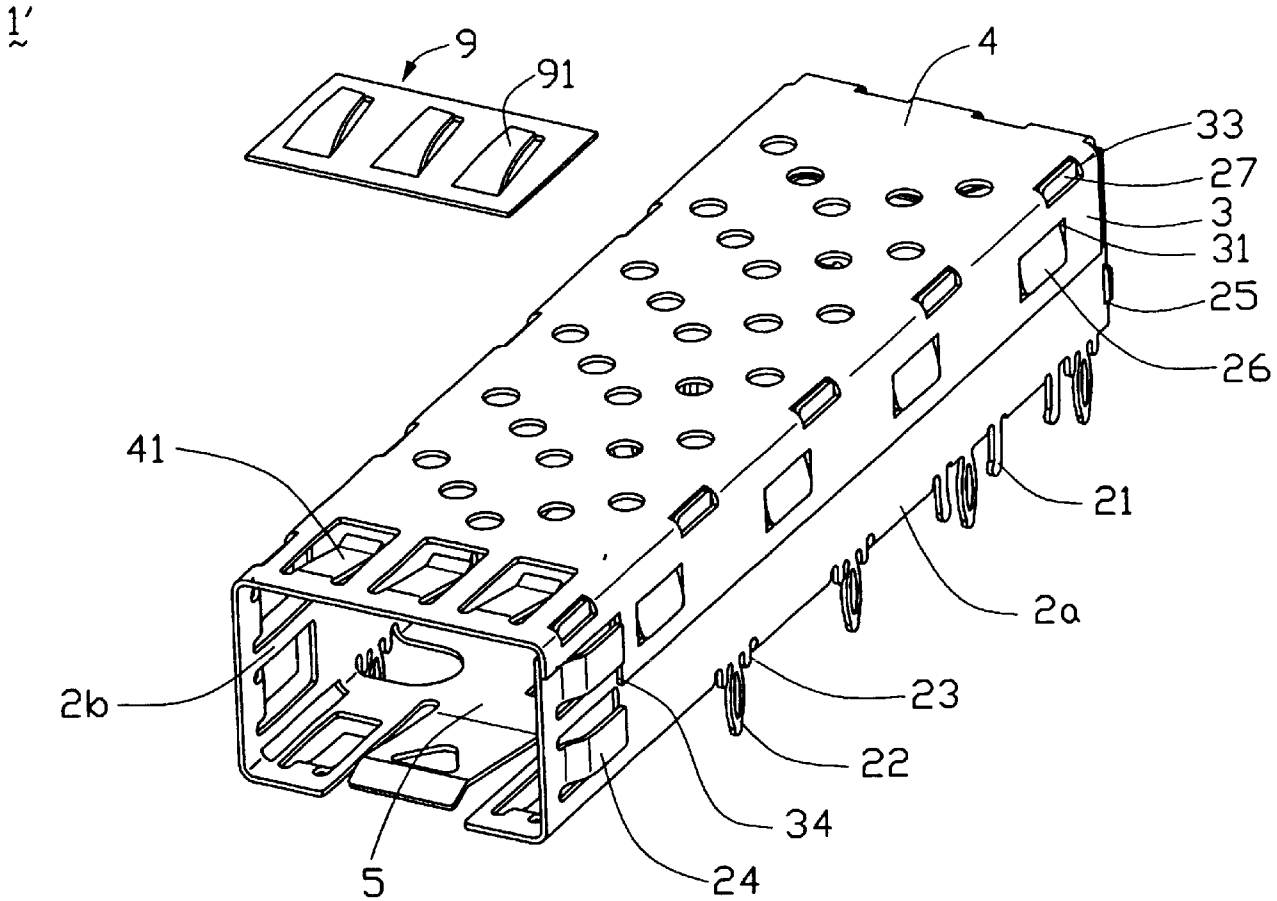
FIG. 1 is an exploded view of an SFP transceiver cage in accordance with a preferred embodiment of the present invention.
Figure 2:
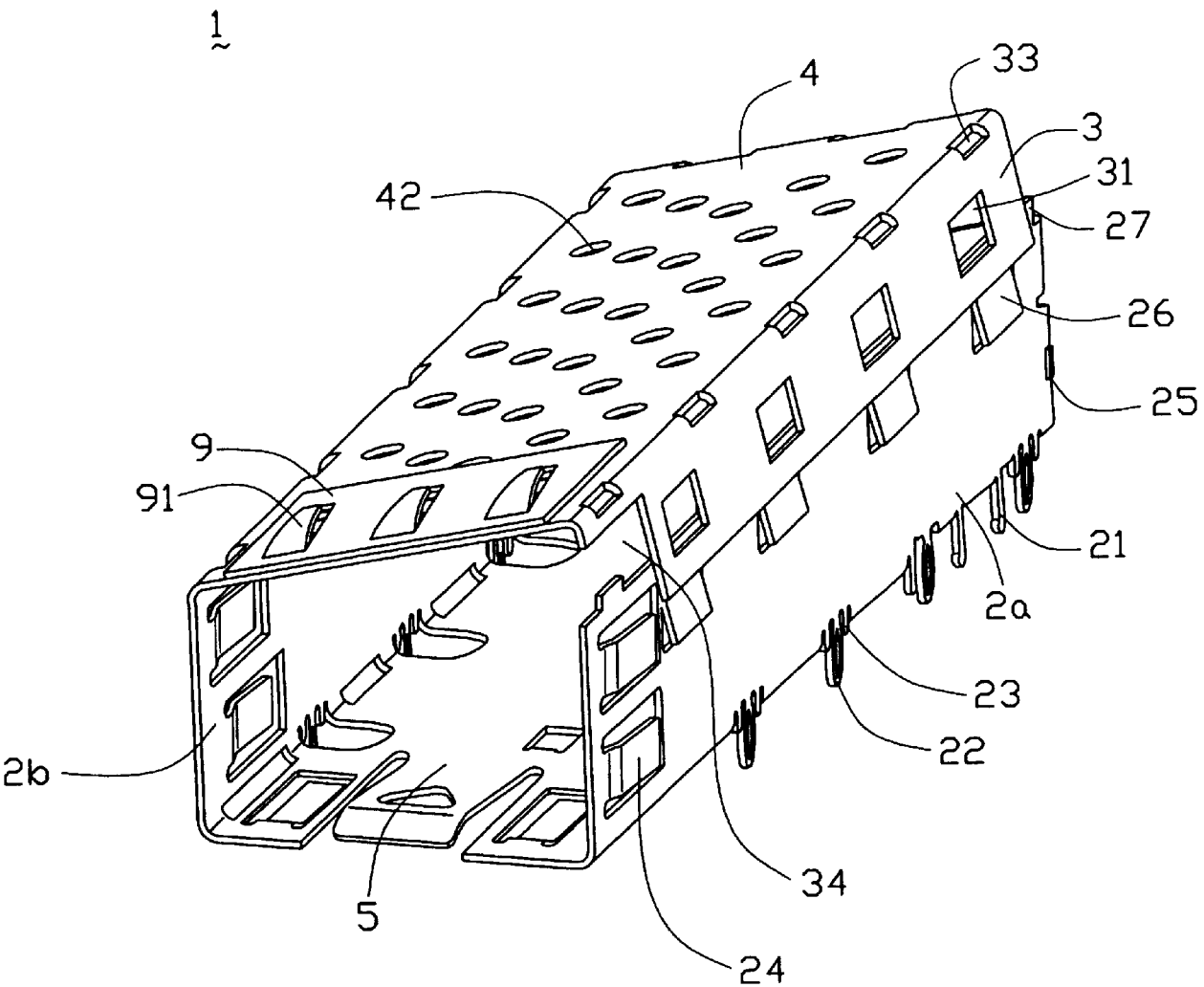
FIG. 2 is a perspective view of the SFP transceiver cage of FIG. 1, showing an outer grounding plate of the cage mounted on a top plate of the cage, and showing a sidewall cover of the cage detached from a sidewall of the cage.
Figure 3:
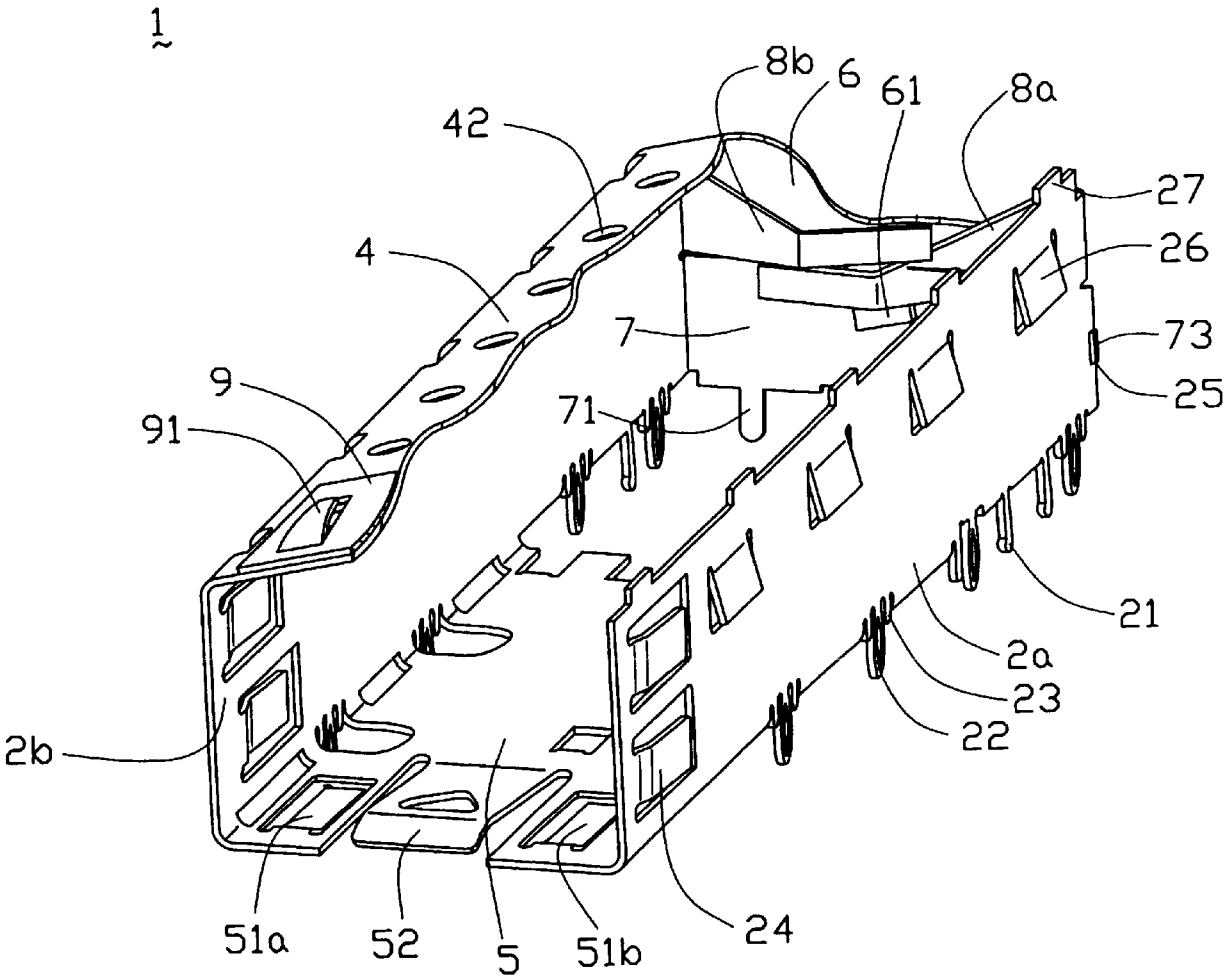
FIG. 3 is similar to FIG. 2, but with a portion of the cage cut away for clarity.

Referring to FIGS. 1–3, a small form-factor pluggable (SFP) transceiver cage 1 in accordance with a preferred embodiment of the present invention comprises a first sidewall 2*a*, a second sidewall 2*b*, a sidewall cover 3, a top plate 4, a bottom wall 5, a rear cover, and two spring arms 8*a*, 8*b*, and outer grounding plate 9. The rear cover includes an outer panel 6 and an inner panel 7. The outer grounding plate 9 has a plurality of outward grounding spring tabs 91 formed on a front top surface thereof. The cage 1 is generally parallelepiped. The sidewalls 2*a*, 2*b*, sidewall cover 3, top plate 4, bottom wall 5, outer panel 6, inner panel 7, and spring arms 8*a*, 8*b* are collectively preferably made from a single piece of blank material such as a metal plate, or may alternatively be made from two pieces of blank material.

Each sidewall 2*a*, 2*b* forms two outward grounding spring tabs 24 proximate a front end thereof, and a plurality of compliant legs 21, needle eye legs 22 and support legs 23 depending from a lower edge thereof. The first sidewall 2*a* also forms a plurality of resilient clasps 26 along an upper portion thereof, and a plurality of locating tabs 27 along a top edge thereof. A notch 25 is defined in a rear edge of the first sidewall 2*a*. The spring arms 8*a*, 8*b* inwardly extend generally perpendicularly from rear edges of the first and second sidewalls 2*a*, 2*b* respectively.

Figure 5:
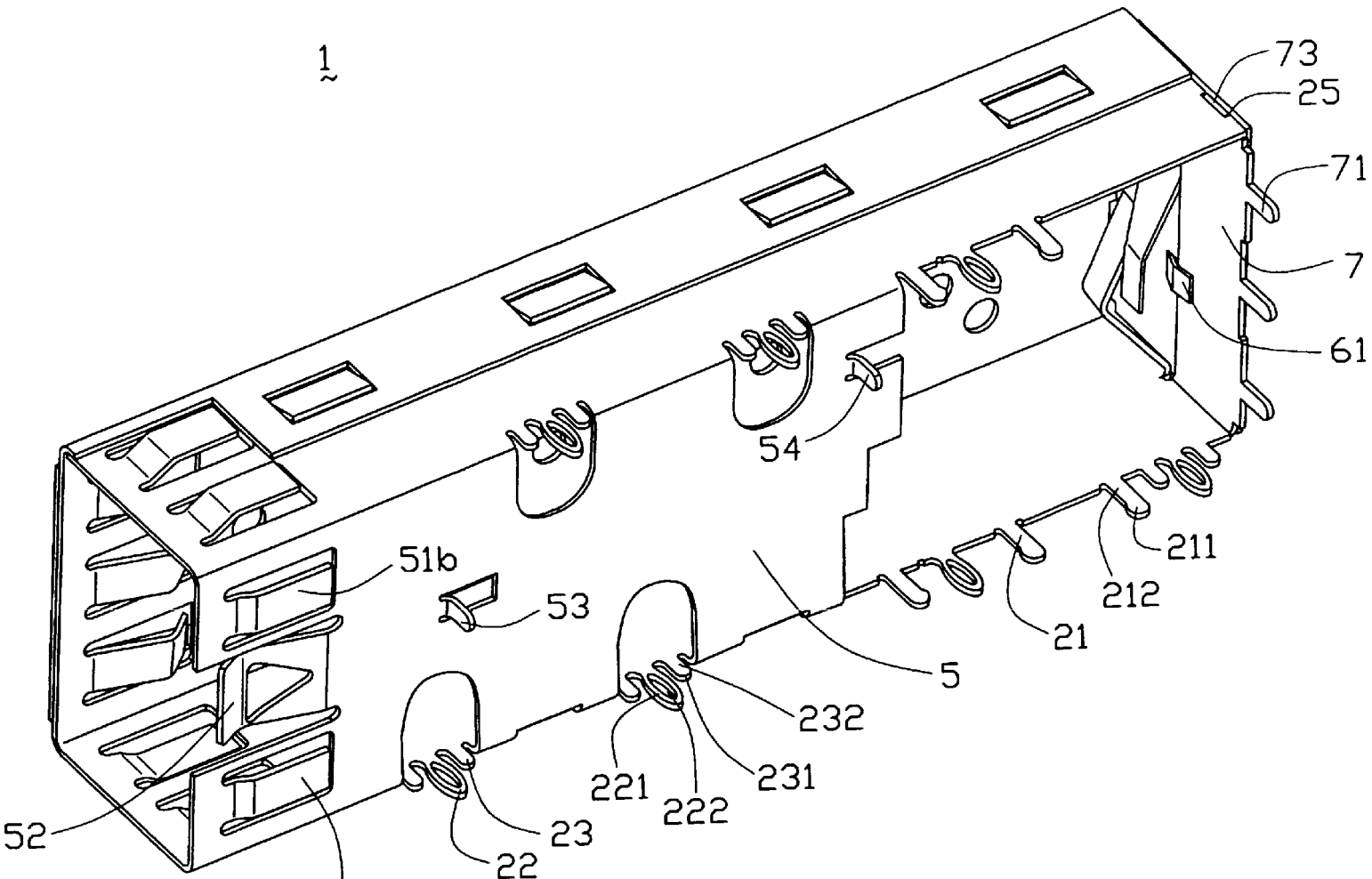
FIG. 5 is similar to FIG. 1, but viewed from a bottom aspect, and showing the outer grounding plate of the cage mounted on the top plate of the cage.

Referring particularly to FIG. 5, the compliant legs 21, needle eye legs 22 and support legs 23 are all substantially co-planar with their respective corresponding sidewalls 2*a*, 2*b*. Each compliant leg 21 comprises an elongate body 212, and an offset rounded end 211. The offset rounded end 211 is offset such that it slightly extends either toward a front of the cage 1, or toward a rear of the cage 1. Each needle eye leg 22 comprises an elliptical body 221, and an elliptical hole 222 defined in a middle of the elliptical body 221. A width of the elliptical body 221 is dimensioned so that the needle eye leg 22 can press-fit into a corresponding hole defined in a printed circuit board (PCB). Each support leg 23 comprises an elongate body 232, and a rounded end 231.

Referring back to FIGS. 1 and 2, the sidewall cover 3 extends from the top plate 4 and overlaps the first sidewall 2*a*. A plurality of openings 31 is defined in the sidewall cover 3, for engagingly receiving the clasps 26 of the first sidewall 2*a*. A plurality of rectangular slots 33 is defined in a junction of the sidewall cover 3 and the top plate 4, for engagingly receiving the locating tabs 27 of the first sidewall 2*a*. The sidewall cover 3 defines a cutout 34 in a front portion thereof, for accommodating an upper spring tab 24 of the first sidewall 2*a*.

The top plate 4 forms three inward grounding spring tabs 41 at a front portion thereof. A plurality of holes 42 is defined in middle and rear portions of the top plate 4.

Figure 4:
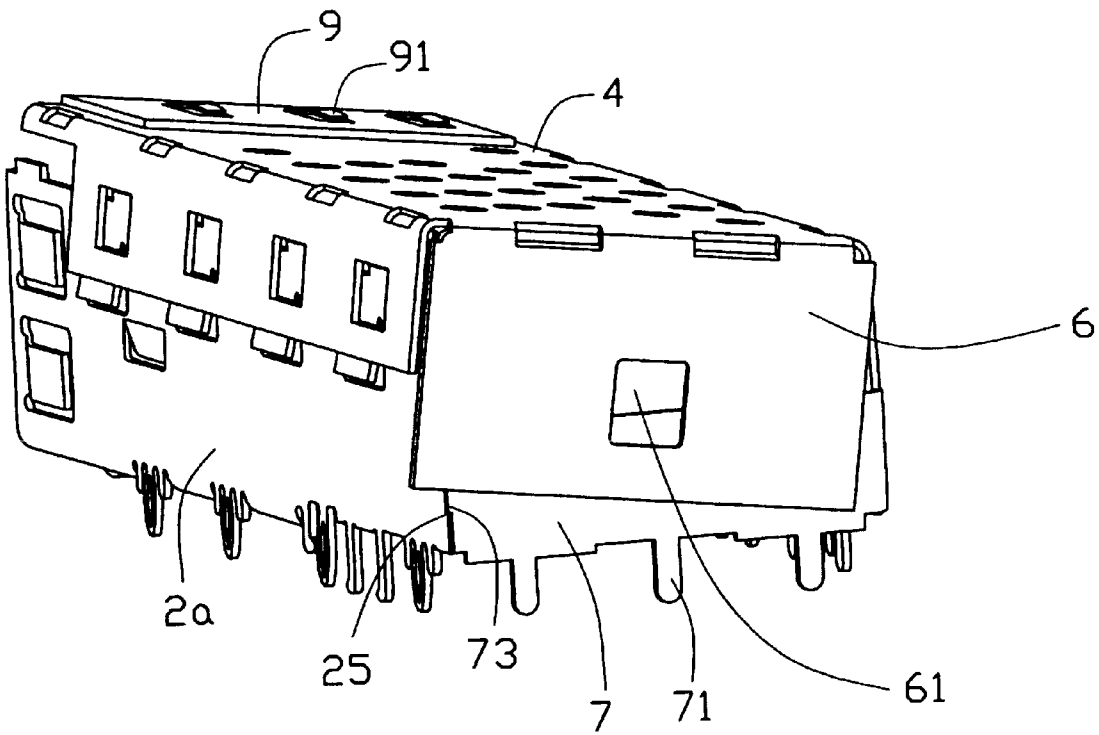
FIG. 4 is similar to FIG. 2, but viewed from a rear aspect.

Referring to FIGS. 3–5, the outer panel 6 of the rear cover extends from the top plate 4. An inward spring tab 61 extends from an inner face of the outer panel 6, for engaging the inner panel 7. The inner panel 7 extends from the second sidewall 2*b*. A plurality of legs 71 depends from a lower edge of the inner panel 7. A projection 73 is formed at a free end of the inner panel 7, for engaging in the notch 25 of the first sidewall 2*a*.

The bottom wall 5 is shorter than the top plate 4. A central inward locking tab 52 with a triangular opening (not labeled) is formed in a front portion of the bottom wall 5, for latchably engaging with a corresponding SFP module. Two outward grounding spring tabs 51*a*, 51*b* are formed in a front portion of the bottom wall 5, on opposite sides of the central tab 52 respectively. A central leg 53 depends from the bottom wall 5 rearward of the central inward tab 52. A rear leg 54 depends from near a rear edge of the bottom wall 5.

In assembly of the cage 1, the outer grounding plate 9 is mounted on a front portion of the top plate 4, over the inward grounding spring tabs 41. The outer grounding plate 9 may be spot welded to the top plate 4, or hooked onto the top plate 4 using hooks (not shown). The outward grounding spring tabs 91 of the outer grounding plate 9 are generally symmetrically opposite the inward grounding spring tabs 41. The projection 73 of the inner panel 7 is engaged in the notch 25 of the first sidewall 2*a*. The top plate 4 and side cover 3 are bent such that the side cover 3 is fastened over first sidewall 2*a*. The inward spring tab 61 of the outer panel 6 engages the inner panel 7, thereby fixing the outer panel 6 in place. The clasps 26 of the first sidewall 2*a* are engaged in the openings 31 of the side cover 3. The locating tabs 27 of the first sidewall 2*a* are engaged in the rectangular slots 33. The sidewall cover 3 is thereby secured to the first sidewall 2*a*, forming the cage 1. The spring arms 8*a*, 8*b* are located above the inner panel 7. The spring arms 8*a*, 8*b* facilitate resilient ejection of an SFP module from the cage 1.

Referring particularly to FIG. 5, in mounting the cage 1 to the PCB, the compliant legs 21 and needle eye legs 22 are extended through corresponding holes defined in the PCB. The offset rounded ends 211 of the compliant legs 21 resiliently press against the PCB at the corresponding holes. The needle eye legs 22 are press-fitted into the corresponding holes of the PCB. The support legs 23 abut a face of the PCB. The central and rear legs 53, 54 of the bottom wall 5 also abut the face of the PCB. The offset rounded ends 211 of the compliant legs 21 and the elliptical bodies 221 of the needle eye legs 22 lock the cage 1 on the PCB. Thus the cage 1 can be firmly and stably secured on the PCB with or without soldering. If the cage 1 is secured on the PCB with soldering, the compliant legs 21 and needle eye legs 22 prevent the cage 1 from moving relative to the PCB during the course of solder reflowing. Furthermore the support legs 23 and central and rear legs 53, 54 serve as standoffs, separating the cage 1 from the PCB to facilitate accurate soldering.

The inward grounding spring tabs 41 of the top plate 4 project into a cavity (not labeled) of the cage 1 for contacting a housing an SFP module (not shown) secured in the cage 1. The outward grounding spring tabs 24, 91, 51*a*, 51*b* respectively of the sidewalls 2*a*, 2*b* top plate 4 and bottom wall 5 project out from the cage 1 for contacting external grounding sources. The inward grounding spring tabs 41 and outward grounding spring tabs 24, 91, 51*a*, 51*b* cooperate to provide multiple grounding paths and prevent electromagnetic interference (EMI).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A small form-factor pluggable transceiver cage comprising:

a top plate forming a plurality of inward spring tabs;

a bottom wall opposite to the top plate;

first and second parallel sidewalls positioned between the top plate and the bottom wall, the first sidewall integrally connected to the bottom wall, the second sidewall integrally connected to both the bottom wall and the top plate;

a sidewall cover extending from one edge of the top plate and at least partially overlapping the first sidewall; and a rear cover including inner and outer panels, the inner panel integrally extending from a rear edge of one of the first and second sidewalls toward the other of the first and second sidewalls; and an outer grounding plate mounted on the top plate; wherein the outer grounding plate defines at least one spring tab extending out from the cage; wherein the top plate, the bottom wall, the first and second sidewalls, the sidewall cover and the rear cover are collectively made from a single piece of metallic material.

2. The cage as described in claim 1, wherein the outer plate is spot welded on the top plate.

3. The cage as described in claim 1, wherein the outer grounding plate is hooked onto the top plate with at least one hook.

4. The cage as described in claim 1, wherein the inward spring tabs project into the cage for contacting a corresponding small form-factor pluggable module, thereby providing multiple grounding paths and preventing electromagnetic interference.

5. The cage as described in claim 1, wherein the at least one spring tab of the outer plate is generally symmetrically opposite the inward spring tab of the top plate.

6. A cage assembly for use with a panel and an optical device, comprising:

a top plate;

a bottom wall opposite to said top plate;

two sidewalls positioned on two sides and between said top plate and said bottom wall;

a sidewall cover extending from one edge of the top plate and at least partially overlapping one of said two sidewalls;

said top plate, said bottom wall and two sidewalls commonly defining a space for receiving the optical device therein;

a locking tab formed on a front portion of the bottom plate for locking with said optical device; and a plurality of grounding tabs formed on front portions of the top plate and two sidewalls; wherein some of said grounding tabs which are formed on one of said front portions, all extend inwardly toward the space for mechanically and electrically engaging the optical device, and a separate grounding plate mounted on said one of the front portions and opposite to said space, forms a plurality of outwardly extending grounding tabs for mechanically and electrically engaging the panel; wherein the top plate, the bottom wall, the two sidewalls and the sidewall cover are collectively made from a single piece of metallic material.

* * * * *